US009717289B1

(12) United States Patent
Fooden et al.

(10) Patent No.: US 9,717,289 B1
(45) Date of Patent: Aug. 1, 2017

(54) GARMENTS HAVING TARGETED COMPRESSIVE AREAS AND METHODS OF MANUFACTURING THE SAME

(71) Applicant: Spanx, Inc., Atlanta, GA (US)

(72) Inventors: Grace Fooden, Atlanta, GA (US); Tosha Hays, Atlanta, GA (US); John Nowell, Cumming, GA (US); Krysta Lin, Long Beach, CA (US); Chad Lawrence, Alpharetta, GA (US)

(73) Assignee: Spanx, Inc., Atlanta, GA (US)

( * ) Notice: Subject to any disclaimer, the term of this patent is extended or adjusted under 35 U.S.C. 154(b) by 375 days.

(21) Appl. No.: 14/317,780

(22) Filed: Jun. 27, 2014

(51) Int. Cl.
*A41D 7/00* (2006.01)

(52) U.S. Cl.
CPC ..... *A41D 7/00* (2013.01); *A41B 2300/52* (2013.01); *A41D 2400/38* (2013.01)

(58) Field of Classification Search
CPC ... A41B 2300/52; A41D 7/00; A41D 2400/38
See application file for complete search history.

(56) References Cited

U.S. PATENT DOCUMENTS 4,701,964 A 10/1987 Bell et al.
5,447,462 A * 9/1995 Smith ..... A41C 1/003 2/73
7,228,809 B2 6/2007 Angelino et al.
7,240,371 B2 7/2007 Liu et al.
7,749,207 B2 7/2010 Rossi et al.
7,828,925 B2 11/2010 Perron et al.
8,176,864 B2 5/2012 Angelino et al.
8,196,220 B2 6/2012 Rance et al.
8,215,251 B2 7/2012 Welsch et al.
8,286,262 B2 10/2012 Rance et al.
(Continued)

FOREIGN PATENT DOCUMENTS

EP 1935265 B1 8/2007

OTHER PUBLICATIONS

Land's End, Shape and Enhance Collection, Halter One Piece Swimsuit Item #425072-AL0, available at http://www.landsend.com/products/womens-shape-enhance-one-piece-swimsuit/id_248768 (accessed Jun. 2014).

*Primary Examiner* — Khaled Annis
(74) *Attorney, Agent, or Firm* — Meunier Carlin & Curfman LLC

(57) ABSTRACT

An article of swimwear for providing targeted compression areas includes inner and outer fabric layers that are bonded together with adhesive layers having different compressive strengths. For example, a first adhesive layer is disposed between first fabric portions of the inner and outer fabric layers. In addition, a second adhesive layer is disposed between second fabric portions of the inner and outer fabric layers. The first and second fabric portions may be laterally adjacent each other or spaced apart. The first adhesive layer provides a first compressive strength to the first fabric portions of the inner and outer fabrics when bonded there between, and the second adhesive layer provides a second compressive strength to the second fabric portions of the inner and outer fabrics when bonded there between. In certain implementations, the first compressive strength is greater than the second compressive strength.

5 Claims, 13 Drawing Sheets

(56) References Cited

U.S. PATENT DOCUMENTS

| | | | | |
|---|---|---|---|---|
| 8,551,278 | B2 * | 10/2013 | Abbott | A41C 3/0014 156/291 |
| 2007/0084390 | A1 | 4/2007 | Angelino et al. | |
| 2007/0213457 | A1 | 9/2007 | Liu et al. | |
| 2007/0226870 | A1 | 10/2007 | Abbott | |
| 2007/0264462 | A1 | 11/2007 | Covelli et al. | |
| 2008/0004395 | A1 | 1/2008 | Covelli et al. | |
| 2008/0302460 | A1 | 12/2008 | Angelino et al. | |
| 2009/0047481 | A1 | 2/2009 | Welsch et al. | |
| 2009/0088037 | A1 | 4/2009 | Covelli et al. | |
| 2009/0089911 | A1 * | 4/2009 | Smith | A41D 3/04 2/69 |
| 2009/0181599 | A1 | 7/2009 | Farmer et al. | |
| 2009/0300816 | A1 | 12/2009 | Brito et al. | |
| 2011/0003533 | A1 | 1/2011 | Caruso et al. | |
| 2011/0041232 | A1 | 2/2011 | Covelli et al. | |
| 2012/0272430 | A1 | 11/2012 | Angelino et al. | |
| 2013/0280504 | A1 * | 10/2013 | Kelsey | B32B 5/04 428/197 |
| 2013/0312153 | A1 | 11/2013 | Abbott | |
| 2014/0090142 | A1 * | 4/2014 | Waller | A41D 7/00 2/67 |

* cited by examiner

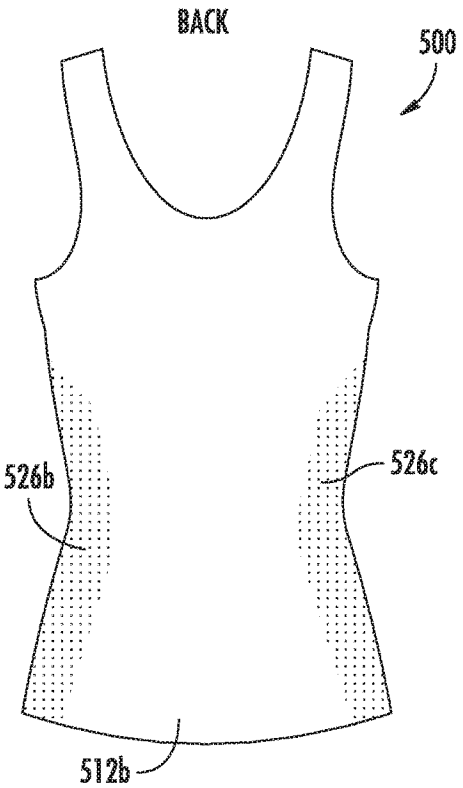
FIG. 5B
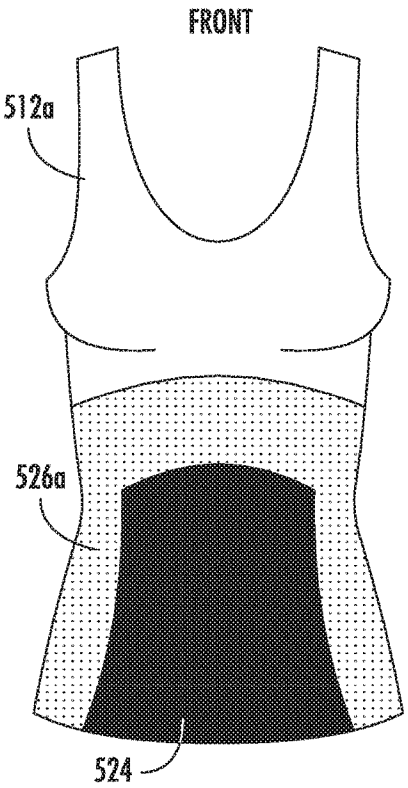
FIG. 5A
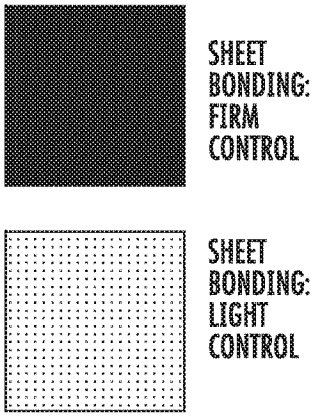

GARMENTS HAVING TARGETED COMPRESSIVE AREAS AND METHODS OF MANUFACTURING THE SAME

BACKGROUND

Wearers of swimwear or other garments may desire to have certain areas of the body compressed to provide a smoother, slimmer, and/or more aesthetically pleasing fit. For example, compression around the belly, hips, and sides of the wearer's abdomen may be desirable. A current swimwear garment that provides a compression area over the wearer's abdomen employs a knit compression inner lining fabric that is sewn to the inside of the outer fabric of the swimsuit. However, providing compression via a knit fabric alone requires a substantial amount of fabric to provide a high modulus of elasticity, which makes the garment relatively heavy compared to garments without compression areas. In addition, knit fabrics may not provide a sufficient amount of compression. Furthermore, current knit compression linings are sewn to the outer fabric, which may result in a detectable stitch line that is not aesthetically pleasing or comfortable to the wearer.

Accordingly, an improved garment, such as swimwear, having one or more targeted compression areas and method of manufacturing the same are needed.

BRIEF SUMMARY

An improved garment is described herein that includes adhesive layers having different compressive strengths bonded between inner and outer fabric layers adjacent targeted compression areas. According to various implementations, the inner fabric layer is configured for being disposed against a wearer's skin, and the outer fabric layer is generally visible to an onlooker. A first adhesive layer is disposed between first portions of the inner and outer fabric layers. In addition, a second adhesive layer is disposed between second portions of the inner and outer fabric layers. The first and second portions may be laterally or vertically adjacent each other or spaced apart from each other. The first adhesive layer provides a first compressive strength to the first fabric portions of the inner and outer fabrics when bonded there between, and the second adhesive layer provides a second compressive strength to the second fabric portions of the inner and outer fabrics when bonded there between. In certain implementations, the first compressive strength is greater than the second compressive strength. For example, in an article of swimwear, the first adhesive layer and first fabric portions may be adjacent the wearer's belly when the article is worn, and the second adhesive layer and second fabric portions may be adjacent the sides of the wearer's abdomen.

In some implementations, the first adhesive layer includes a first polyurethane sheet on which a plurality of dots of adhesive are disposed and spaced apart from each other, and the second adhesive layer comprises a second polyurethane sheet on which a plurality of dots of the adhesive are disposed and spaced apart from each other. To provide more compressive strength, the volume of the dots on the first sheet is greater than the volume of dots on the second sheet. For example, the first compressive strength may be quantified by a modulus of elasticity of between about 3.5 pounds and about 4.5 pounds at 30% elongation, and the second compressive strength may be quantified by a modulus of elasticity of between about 1.35 pounds and about 1.75 pounds at 30% elongation.

Various implementations also include a method of providing one or more compressive areas in a garment. In particular, the method includes: (1) disposing a first side of a first adhesive layer adjacent a first fabric portion of one of an inner or an outer fabric, the inner fabric configured for being disposed against a wearer's skin; (2) disposing a first side of a second adhesive layer adjacent a second fabric portion of the inner or outer fabric; (3) tacking first sides of the first adhesive layer and the second adhesive layer to the first and second fabric portions, respectively, of the inner or outer fabric, wherein tacking comprises applying heat and pressure to the first and second fabric portions of the inner or outer fabric; (4) aligning a first fabric portion of the other of the outer or inner fabric to a second side of the first adhesive layer, the second side of the first adhesive layer being opposite the first side of the first adhesive layer; (5) aligning a second fabric portion of the other of the outer or inner fabric to a second side of the second adhesive layer, the second side of the second adhesive layer being opposite the first side of the second adhesive layer; (6) tacking the second sides of the first adhesive layer and the second adhesive layer to the first and second fabric portions, respectively, of the other of the outer or inner fabric, wherein the first adhesive layer has a first compressive strength when bonded to the first fabric portions of the inner and outer fabrics, and the second adhesive layer has a second compressive strength when bonded to the second fabric portions of the inner and outer fabrics, the first compressive strength being greater than the second compressive strength.

In certain implementations, disposing a first side of a first adhesive layer and a first side of a second adhesive layer includes directly applying the first and second adhesive layers to the first and second portions of fabric, respectively. In other implementations, the method further includes removing a backing from the second sides of the first and second adhesive layers prior to tacking the second sides of the adhesive layers to the respective first and second fabric portions of the other of the inner or outer fabric.

BRIEF DESCRIPTION OF THE DRAWINGS

Various implementations of garments, such as articles of swimwear, and methods of providing the same are explained in relation to the following drawings. These drawings are exemplary, and certain features shown may be used singularly or in combination with other features. The disclosure should not be limited to the examples shown.

FIGS. 5A and 5B illustrate front and back inner fabrics of a tankini-type swimsuit according to one implementation.

DETAILED DESCRIPTION

An improved garment is described herein that includes adhesive layers having different compressive strengths bonded between inner and outer fabric layers adjacent targeted compression areas. According to various implementations, the inner fabric layer is configured for being disposed against a wearer's skin, and the outer fabric layer is generally visible to an onlooker. A first adhesive layer is disposed between first portions of the inner and outer fabric layers. In addition, a second adhesive layer is disposed between second portions of the inner and outer fabric layers. The first and second portions may be laterally or vertically adjacent each other or spaced apart from each other. The first adhesive layer provides a first compressive strength to the first fabric portions of the inner and outer fabrics when bonded there between, and the second adhesive layer provides a second compressive strength to the second fabric portions of the inner and outer fabrics when bonded there between. In certain implementations, the first compressive strength is greater than the second compressive strength. For example, in an article of swimwear, the first adhesive layer and first fabric portions may be adjacent the wearer's belly when the article is worn, and the second adhesive layer and second fabric portions may be adjacent the sides of the wearer's abdomen.

Figure 1A:
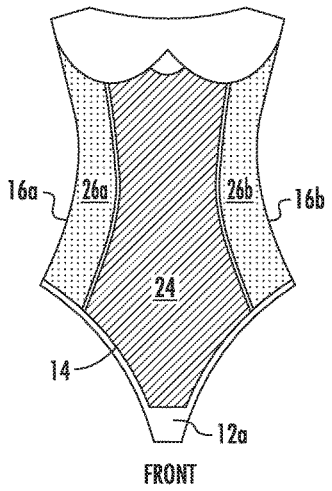
FIGS. 1A and 1B illustrate front and back inner fabrics, respectively, of a one-piece type swimsuit according to one implementation.

FIGS. 1A through 1F illustrate various layers of a one piece style swimsuit 10 according to one implementation. In particular, the swimsuit 10 includes a front inner fabric 12*a*, a back inner fabric 13*b*, first adhesive layer 24, second adhesive layers 26*a*, 26*b*, a front outer fabric 18*a*, and a back outer fabric 18*b*. FIG. 1A illustrates the front inner fabric 12*a* having a central fabric portion 14, or area, that is disposed over a central portion of an abdomen of the wearer when worn and side fabric portions 16*a*, 16*b* that are disposed laterally adjacent the central fabric portion 14 such that the side portions 16*a*, 16*b* are disposed over a portion of each side of the wearer's abdomen. A first side of the first adhesive layer 24 is tacked, or bonded using heat and pressure, to the central fabric portion 14, and first sides of second adhesive layers 26*a*, 26*b* are tacked to the side fabric portions 16*a*, 16*b*, respectively, of the inner front fabric 12*a*.

Figure 1B:
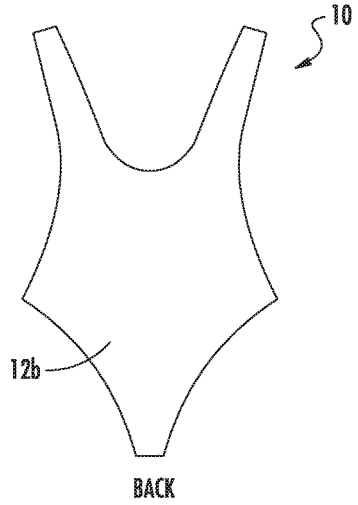
Figure 1C:
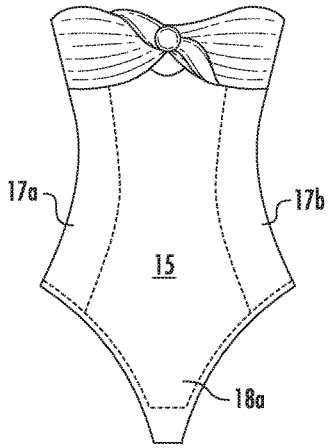
FIGS. 1C and 1D illustrate front and back outer fabrics, respectively, of the one-piece type swimsuit shown in FIGS. 1A and 1B.

FIG. 1C illustrates the front outer fabric 18*a* having a central fabric portion 15 and side fabric portions 17*a*, 17*b* that substantially align with the central fabric portion 14 and the side fabric portions 16*a*, 16*b* of the front inner fabric 12*a*, respectively, when the front inner 12*a* and front outer fabrics 18*a* are attached relative to each other. The central fabric portion 15 of the front outer fabric 18*a* is aligned with and tacked to a second, opposite side of the first adhesive layer 24, and the side fabric portions 17*a*, 17*b* of the front outer fabric 18*a* are aligned with and tacked to second, opposite sides of the second adhesive layers 26*a*, 26*b*, respectively.

Figure 1D:
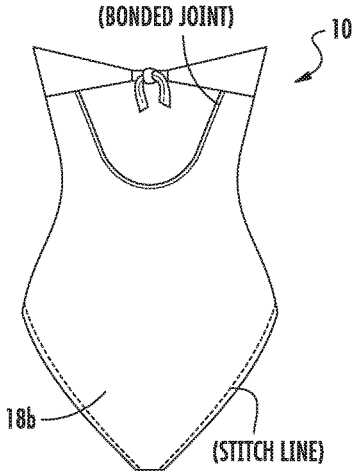

FIG. 1B illustrates the back inner fabric 12*b*, and FIG. 1D illustrates the back outer fabric 18*b*. The back inner fabric 12*b* and the back outer fabric 18*b* are attached to each other and to the front fabrics 12*a*, 18*a* of the swimsuit 10. The back fabrics 12*b*, 18*b* of the swimsuit 10 may be bonded and/or sewn to each other along one or more edges of the fabrics 12*b*, 18*b* or at one or more areas of the fabrics 12*b*, 18*b* disposed inwardly of the edges of the fabrics 12*b*, 18*b*. In addition, the back fabrics 12*b*, 18*b* may be bonded to the front fabrics 12*a*, 18*a* using an adhesive strip between the respective fabrics and/or sewn to the front fabrics 12*a*, 18*a* along the edges of the fabrics and/or areas disposed inwardly of the edges. For example, in the implementation shown in FIG. 1D, the joint between the inner back fabric 12*b* and outer back fabric 18*b* adjacent the wearer's mid back, the joint between the inner 12*a* and outer front fabric 18*a* adjacent the wearer's pelvis, and the joint attaching the inner front 12*a* and back fabrics 18*a* and the outer front 18*a* and back fabrics 18*b* along the lateral sides thereof are bonded together by applying heat and pressure to an adhesive disposed on the fabrics to provide a smoother, more "seamless" look. The joint between the inner 12*b* and outer back fabric 18*b* extending over the wearer's bottom is stitched, creating a seam. In other implementations, one or more of these fabric portions may be joined using an ultrasonic machine to trim and produce a butt joint between the two fabrics. This joint is subsequently reinforced with adhesive seam reinforcing tape. According to various implementations, bonding joints of fabric as opposed to stitching them together reduces seam bulk, reduces chafing on the wearer's skin adjacent the joint, and has a very low profile.

Figure 1E:
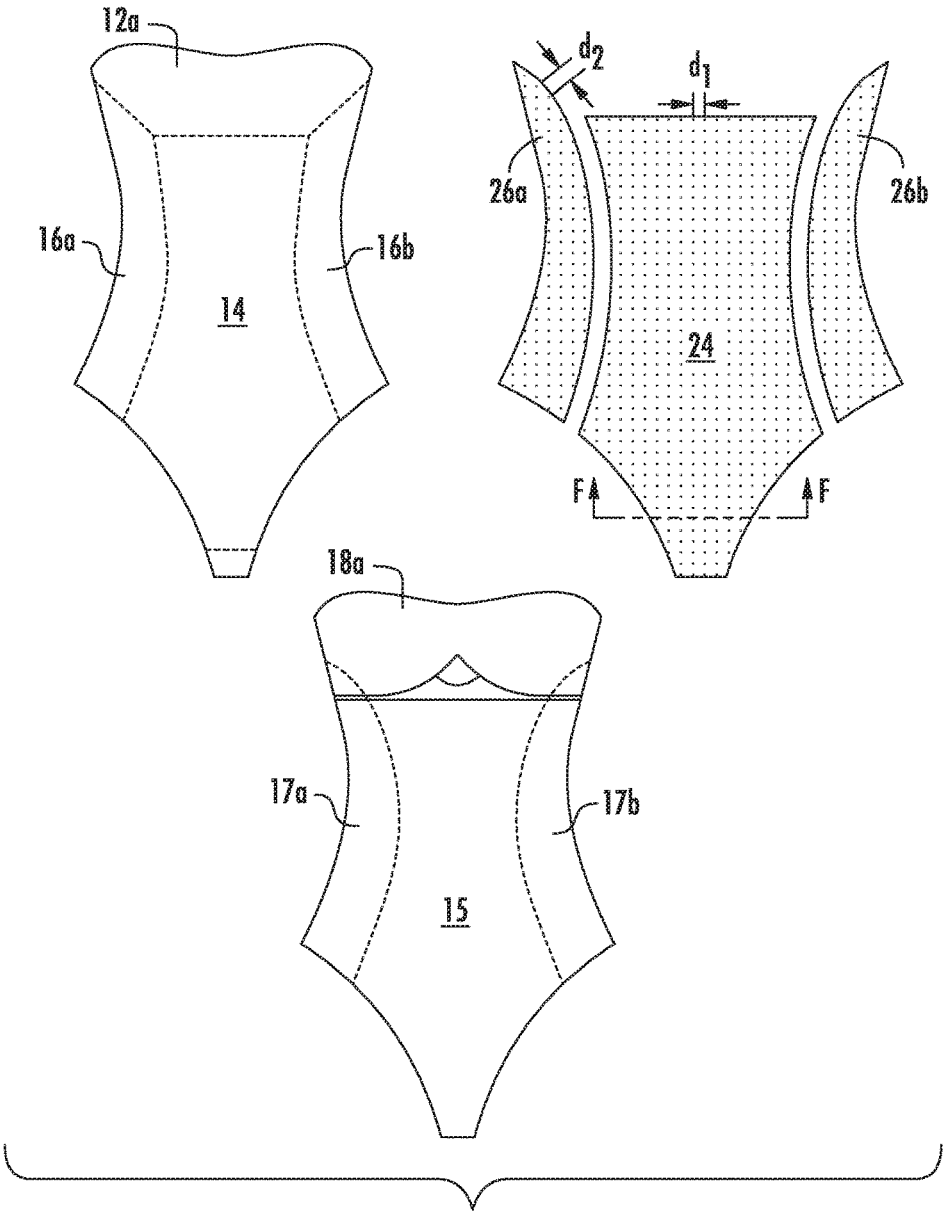
FIG. 1E illustrates a perspective view of the front inner fabric, first and second adhesive layers, and front outer fabric shown in FIGS. 1A through 1D.
Figure 1F:
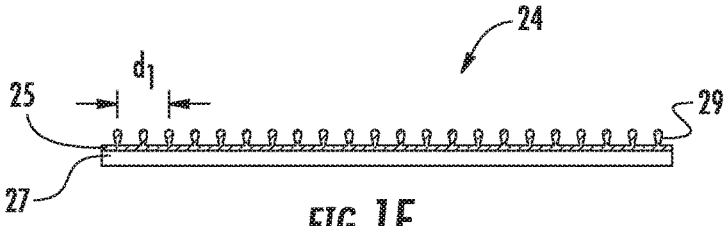
FIG. 1F illustrates a cross sectional view of the first adhesive layer as taken through the F-F line shown in FIG. 1E.

FIG. 1E illustrates an exploded view of the front inner fabric 12*a*, first 24 and second adhesive layers 26*a*, 26*b*, and the front outer fabric 18*a*. FIG. 1F illustrates a cross-sectional view of the first adhesive layer 24 taken through the F-F line shown in FIG. 1E. As shown in FIGS. 1E and 1F, the first adhesive layer 24 includes a polyurethane film 25 having a first side and a second, opposite side. A plurality of adhesive dots 29 (or "pin dots") are disposed on the first side of the film 25 and are spaced apart from each other a certain distance dl, and a backing layer 27 is disposed on the second side of the film 25. The adhesive dots 29 may be a polyamide adhesive or a polyurethane adhesive, for example. The backing layer 27 may include paper or other material that is resistant to melting or burning when heat and pressure are applied to the adhesive layer 24 and prevents the second side of the film 25 from melting or bonding to an unintended object, such as a press component. The second adhesive layers 26*a*, 26*b* are similar to the adhesive layer 24 shown in FIG. 1F, but the volume of each adhesive dot decreases to reduce the amount of compressive strength the adhesive layer provides to the inner and outer fabrics after tacking them together. For example, the thickness of the adhesive dots may increase while the pattern and area covered by each dot remains substantially the same to increase the compressive strength of the fabrics bonded together. Or, the area covered by each dot may increase while the thickness and overall pattern remains substantially the same to increase the compressive strength of the fabrics bonded together. And, in yet another implementation, the thickness and pattern may change to increase or decrease the compressive strength of the fabrics bonded together. In certain implementations, the adhesive layers 24, 26*a*, 26*b* are manufactured by Freudenberg and are cut to a particular shape based on the portion of the garment for which increased compression is needed. And, in other implementations, the adhesive dots may be applied to the inner or outer fabric directly using a direct transfer process. In the direct transfer process, one of the inner or outer fabrics is passed below a screen, and adhesive is extruded through the screen onto the fabric below. The other of the inner or outer fabric is then aligned and bonded to the fabric with the adhesive applied thereto.

The adhesive layers provide a certain compressive strength to the inner and outer fabrics when bonded there between. For example, referring back to the implementations shown in FIGS. 1A-1F, the first adhesive layer 24 may provide a modulus of elasticity of about 3.5 to about 4.5 pounds of force to extend the bonded fabrics 30% (e.g., about 3.93 lbs.) and about 10 to about 12 pounds of force to extend the bonded fabrics 50% (e.g., about 10.98 lbs.). Alternatively or in addition thereto, the compressive strength of the fabrics bonded together using the first adhesive layer 24 may be quantified as an elongation of between about 62% to about 66% using 100 Newtons of force (e.g., about 63.99%). The second adhesive layers 26*a*, 26*b* provide a modulus of elasticity of between about 1.35 pounds and about 1.75 pounds to extend the bonded fabrics 30% (e.g., about 1.55 lbs.) and about 2.94 pounds and about 3.34 pounds to extend the bonded fabrics 50% (e.g., about 3.14 lbs.). In addition, the second adhesive layers 26*a*, 26*b* provide elongation of between about 125% and about 129% using 100 Newtons of force (e.g., about 127%). For the sake of comparison, the inner 12*a* and outer front fabrics 18*a* may have a modulus of elasticity about 1 pound to about 1.2 pounds to extend the fabrics 12*a*, 18*a* 30% (e.g., about 1.12 lbs.) and about 2.08 pounds to about 2.48 pounds to extend the fabrics 12*a*, 18*a* 50% (e.g., about 2.28 lbs.) and an elongation of between about 153% and 157% using 100 Newtons of force when an adhesive layer is not bonded between the fabrics 12*a*, 18*a* (e.g., about 155.12%). Furthermore, in certain implementations, the adhesive weight of the dots may be between about 25 grams per square meter and about 55 grams per square meter.

In other implementations, a film adhesive, which includes a solid layer of glue as opposed to spaced apart dots of glue, may be used instead of the adhesive dots described above. The thickness of the film layer may be increased to provide greater compressive strength or decreased to provide less compressive strength. For example, the adhesive layer may be about 2 mils thick for the first adhesive layer and about 0.5 mils thick for the second adhesive layer. An adhesive layer having a compressive strength that is between that of the first and second layers may have a thickness of about 0.75 to about 1 mil thick. In certain implementations, fabrics bonded using a film adhesive provide a similar compressive effect as fabrics bonded using the dot adhesive, but the fabrics bonded with the film adhesive tend to have a stiffer "hand feel" than the fabrics bonded using the dot adhesive.

As shown in FIGS. 1A, 1C, and 1E, the central fabric portions 14, 15 and the first adhesive layer 24 are substantially hour glass shaped and extend from just below the wearer's chest to just above the respective bottom edges of the front inner fabric 12*a*, the front outer fabric 18*a*, and the first adhesive layer 24. The lateral, or vertically oriented, sides of the central fabric portions 14, 15 and the first adhesive layer 24 curve inwardly slightly toward a central portion of the wearer's abdomen. The side fabric portions 16*a*, 16*b*, 17*a*, 17*b* and second adhesive layers 26*a*, 26*b* extend from a lower portion of the wearer's chest to the leg openings of the swimsuit 10 and are partially crescent shaped. In particular, each of the side fabric portions 16*a*, 16*b*, 17*a*, 17*b* and the second adhesive layers 26*a*, 26*b* has a tapered point adjacent one side of the wearer's chest, a flat, bottom edge along the respective leg opening, and arcuate shaped lateral edges that extend along the wearer's sides between the tapered point and the flat bottom edge. The inner arcuate shaped lateral edges that are adjacent the lateral edges of the central fabric portions 14, 15 and the first adhesive layer 24 substantially follow the same curve of the lateral edges of the central fabric portions 14, 15 and the first adhesive layer 24 such that the adjacent lateral edges may be aligned next to one another. The outer arcuate shaped lateral edges of the side fabric portions 16*a*, 16*b*, 17*a*, 17*b* and the second adhesive layers 26*a*, 26*b* are cut to provide a natural looking curve along the wearer's sides. For example, the outer arcuate shaped lateral edges may extend to the lateral outer edges of the side fabric portions 16*a*, 16*b*, 17*a*, 17*b* and the second adhesive layers 26*a*, 16*b*

The inner front and back fabric 12*a*, 12*b* are cut from a warp knit fabric comprising about 70% nylon and about 30% spandex and having a weight of about 225 grams per square meter (gsm). For example, this fabric may include the "no bubble technology" fabric manufacturer by Best Pacific. However, in other various implementations, the fabric may be a warp or weft knit fabric having about 60% to about 95% nylon or polyester and about 5% to about 40% spandex and weighing between about 80 gsm and about 250 gsm. However in other implementations, other types of fabrics may be selected, such as a polyspandex liner. According to certain implementations, knit fabrics allow for greater stretching and compression than woven fabrics, making garments made with knit fabrics easier to put on and take off.

In addition, articles of swimwear are more frequently exposed to chlorine, salt water, and suntan lotion than other types of garments. This exposure can cause deterioration of the fabrics or adhesive, which may lead to delamination of the fabric layers. Accordingly, various implementations in which the garment is an article of swimwear include fabrics and adhesives that are more resistant to deterioration and delamination. For example, as noted above, warp or weft knit fabrics made from a combination of nylon and spandex that are bonded together using the adhesives described above are resistant to deterioration and lamination.

Decorative features, such as shirred fabric, keyholes, ties, chain stitches, cover stitches, ribbon seams, or other decorative features may also be bonded or sewn onto outer sides of the outer fabric portions 18*a*, 18*b* to finish the swimsuit 10.

Figure 2B:
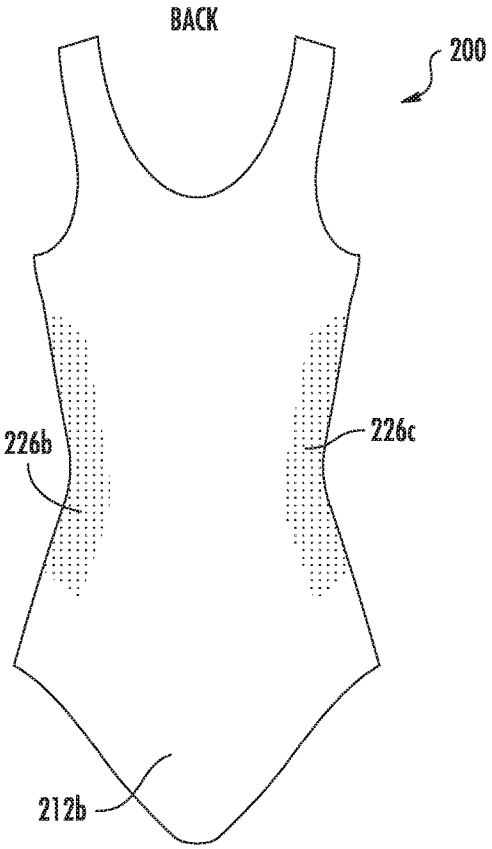
FIGS. 2A and 2B illustrate front and back inner fabrics of a one-piece swimsuit according to another implementation.
Figure 2A:
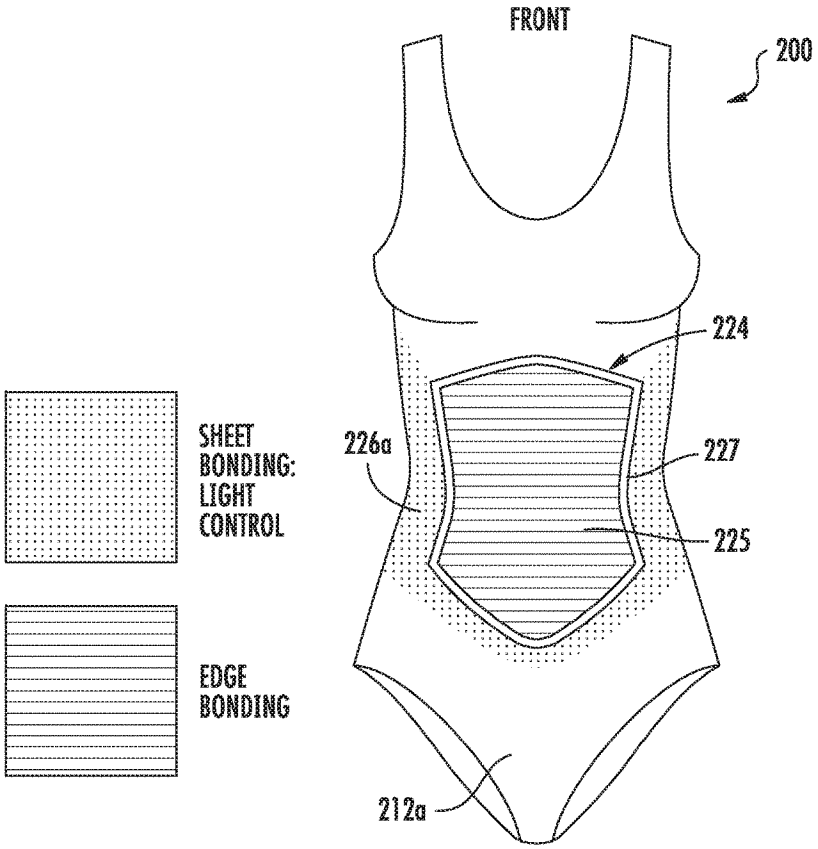

The implementation shown in FIGS. 1A through 1E is just one example of how the article of swimwear may be configured. FIGS. 2A through 11B illustrate various other implementations of different styles of bonded swimwear. For example, FIGS. 2A and 2B illustrate another one-piece style swimsuit 200. FIG. 2A illustrates the front inner fabric 212*a* with a first adhesive layer 224 tacked adjacent a central portion thereof and a second adhesive layer 226*a* tacked adjacent the vertical and bottom edges of the first adhesive layer 224. FIG. 2B illustrates the back inner fabric 212*b* with second adhesive layers 226*b*, 226*c* tacked adjacent vertical side edges of the back inner fabric 212*b*. Similar to the adhesive layers 24, 26*a*, 26*b* described above in relation to FIGS. 1A through 1E, the first adhesive layer 224 has a first compressive strength and the second adhesive layers 226*a-c* have a second compressive strength that is less than the first compressive strength. The first adhesive layer 224 extends between the wearer's lower ribs and the wearer's hips or belly button and has a generally hexagonal, slightly hour glass shape. The vertical edges of the first adhesive layer 224 curve slightly inwardly toward each other, upper horizontal edges taper upwardly, and the lower horizontal edges taper downwardly. The first adhesive layer 224 defines an outer periphery 227 that includes adhesive dots or a film disposed thereon. However, the central portion 225 of the adhesive layer 224 does not include any adhesive. The second adhesive layer 226*a* tacked to the front inner fabric 212*a* is substantially U-shaped, and the second adhesive layers 226*b*, 226*c* tacked to the back inner fabric 212*b* are substantially rectangular shaped. The inner edges of the vertical portions of the second adhesive layer 226*a* are substantially aligned with the outer vertical edges of the first adhesive layer 224. In addition, the outer vertical edges of the vertical portions of the second adhesive layer 226*a* are substantially aligned with the outer vertical edges of the second adhesive layers 226*b*, 226*c*.

Figure 3A:
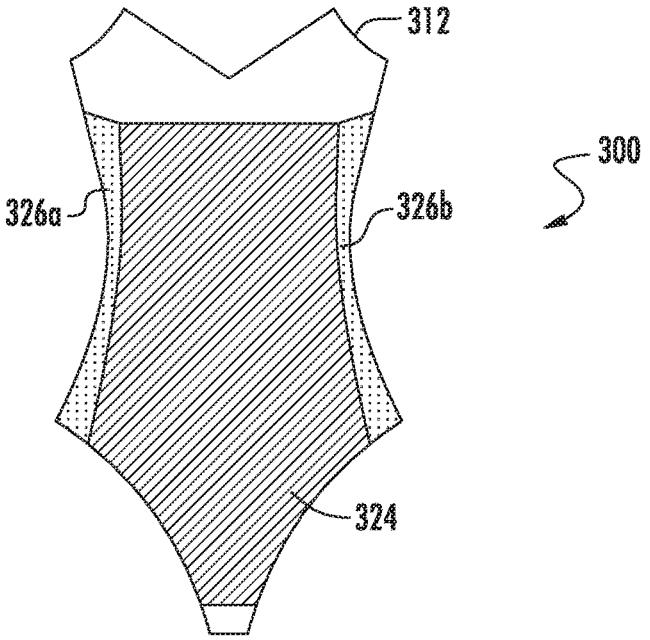
FIGS. 3A and 3B illustrate front inner and outer fabrics of a one-piece swimsuit according to another implementation.
Figure 3B:
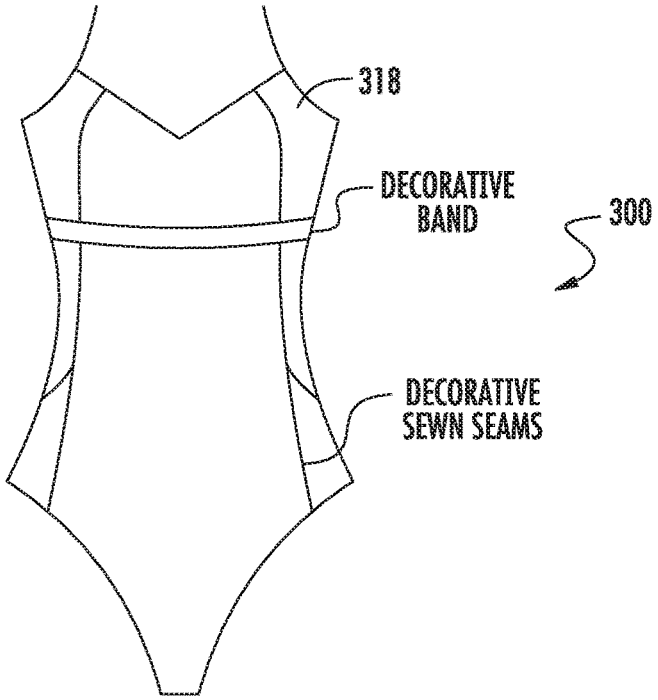

FIGS. 3A and 3B illustrate a one-piece style swimsuit 300 according to another implementation. FIG. 3A illustrates a front inner fabric 312 of the swimsuit 300, and FIG. 3B illustrates a front outer fabric 318 of the swimsuit 300. The back inner and outer fabrics are not shown and may or may not include an adhesive layer between them. The front inner fabric 312 includes a central fabric portion to which a first adhesive layer 324 is tacked and side fabric portions to which second adhesive layers 326*a*, 326*b* are tacked. The first adhesive layer 324 extends vertically between just below the wearer's chest to the leg openings and just above the bottom edge of the front inner fabric 312 and horizontally between the wearer's hip bones. Each second adhesive layer 326*a*, 326*b* extends from the respective adjacent lateral edge of the first adhesive layer 324 toward the side of the wearer's abdomen. The compressive strength of the first adhesive layer 324 is greater than the compressive strength of the second adhesive layers 326*a*, 326*b*.

Figure 4A:
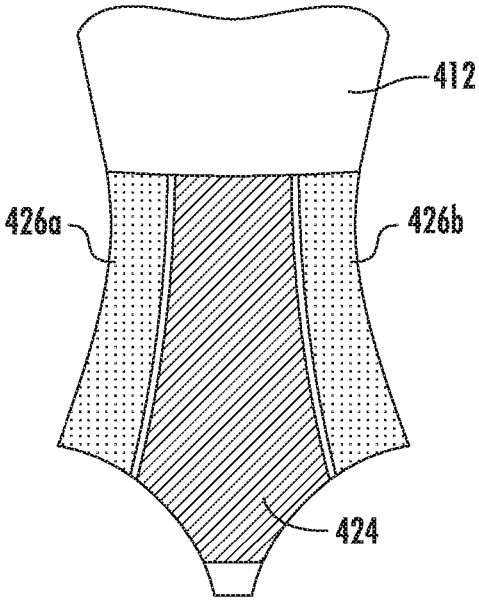
FIGS. 4A and 4B illustrate front inner and outer fabrics of a one-piece swimsuit according to another implementation.
Figure 4B:
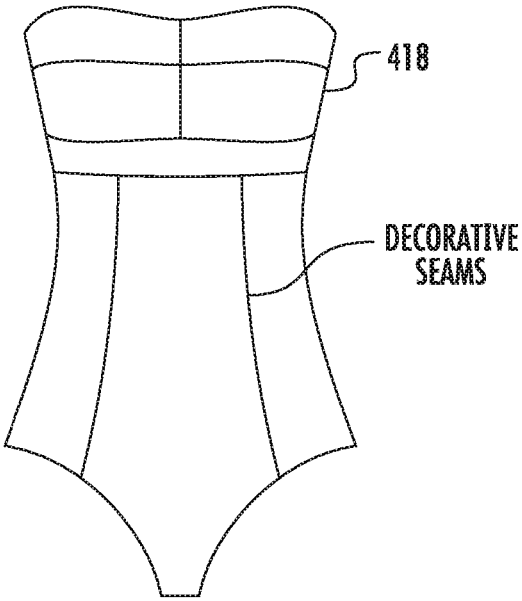

FIGS. 4A and 4B illustrate a one-piece style swimsuit 400 according to another implementation. FIG. 4A illustrates a front inner fabric 412 of the swimsuit 400, and FIG. 4B illustrates a front outer fabric 418 of the swimsuit 400. The back inner and outer fabrics are not shown and may or may not include an adhesive layer between them. The front inner fabric 412 includes a central fabric portion to which a first adhesive layer 424 is tacked and side fabric portions to which second adhesive layers 426*a*, 426*b* are tacked. The first adhesive layer 424 extends vertically between just below the wearer's chest to the leg openings and just above the bottom edge of the front inner fabric 412 and horizontally between a first line that extends between the wearer's right hip bone and belly button and a second line that extends between the wearer's left hip bone and belly button. The first adhesive layer 424 is slightly narrower than the first adhesive layer 324 shown in FIG. 3A. Each second adhesive layer 426*a*, 426*b* extends from the respective adjacent lateral edge of the first adhesive layer 424 toward the respective side of the wearer's abdomen. The compressive strength of the first adhesive layer 424 is greater than the compressive strength of the second adhesive layers 426*a*, 426*b*.

FIGS. 5A and 5B illustrate a tankini-style swimsuit top 500 according to one implementation. FIG. 5A illustrates a front inner fabric 512*a* of the swimsuit 500, and FIG. 5B illustrates a back inner fabric 512*b* of the swimsuit 500. The front inner fabric 512*a* includes a central fabric portion to which a first adhesive layer 524 is tacked and side and upper fabric portions to which a second adhesive layer 526*a* is stacked. The first adhesive layer 524 is adjacent the wearer's belly (central abdomen). The second adhesive layer 526*a* is an inverted U-shape and extends from the lateral edges of the first adhesive layer 524 toward each side of the wearer's abdomen and upwardly from the upper horizontal edge of the first adhesive layer 524 to just below the wearer's chest. The compressive strength of the first adhesive layer 524 is greater than the compressive strength of the second adhesive layers 526*a*. In addition, second adhesive layers 526*b*, 526*c* are tacked adjacent the lateral side edges of the back inner fabric 512*b* such that the lateral edges of the second adhesive layers 526*b*, 526*c* adjacent the side edges of the back inner fabric 512*b* align with the outer side edges of the second adhesive layer 526*a* when the front 512*a* and back inner fabrics 512*b* are joined together. The front and back outer fabrics are not shown, but would be tacked to the adhesive layers 524, 526*a-c* shown in FIGS. 5A and 5B.

Figure 6A:
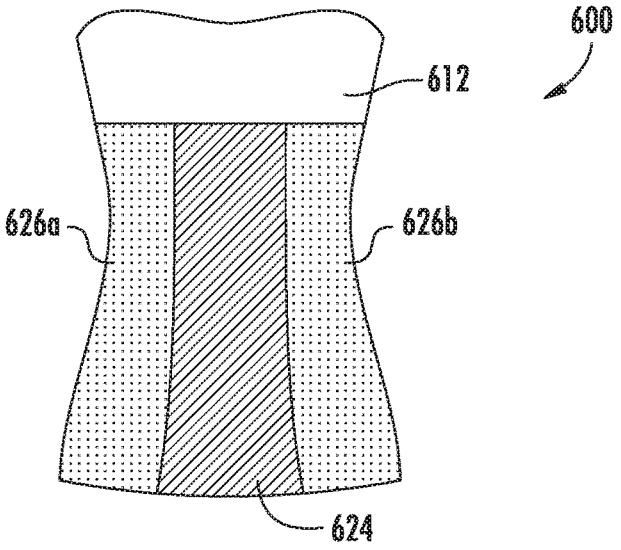
FIGS. 6A and 6B illustrate front inner and outer fabrics of a tankini-type swimsuit according to another implementation.
Figure 6B:
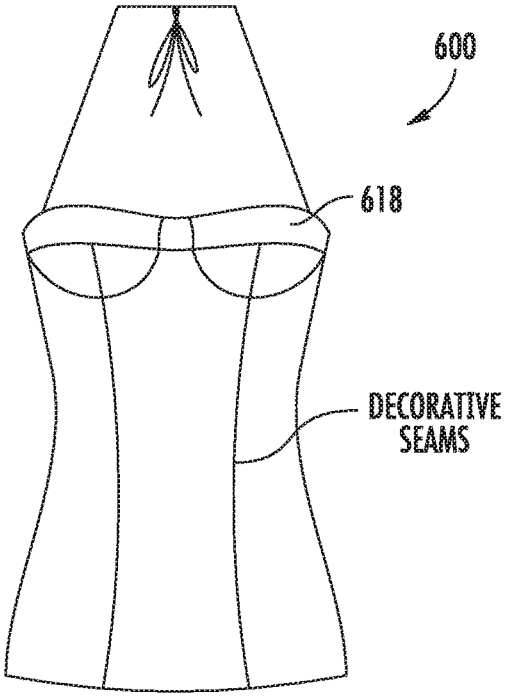

FIGS. 6A and 6B illustrate a tankini style swimsuit top 600 according to another implementation. FIG. 6A illustrates a front inner fabric 612 of the swimsuit 600, and FIG. 6B illustrates a front outer fabric 618 of the swimsuit 600. The back inner and outer fabrics are not shown and may or may not include an adhesive layer between them. The front inner fabric 612 includes a central fabric portion to which a first adhesive layer 624 is tacked and side fabric portions to which second adhesive layers 626*a*, 626*b* are tacked. The first adhesive layer 624 extends between just below the wearer's chest to the bottom horizontal edge of the tankini top 600 and horizontally across the belly button from areas between the wearer's hip bones and belly button. Each second adhesive layer 626*a*, 626*b* extends from the respective adjacent lateral edge of the first adhesive layer 624 toward the respective side of the wearer's abdomen. The compressive strength of the first adhesive layer 624 is greater than the compressive strength of the second adhesive layers 626*a*, 626*b*.

Figure 7A:
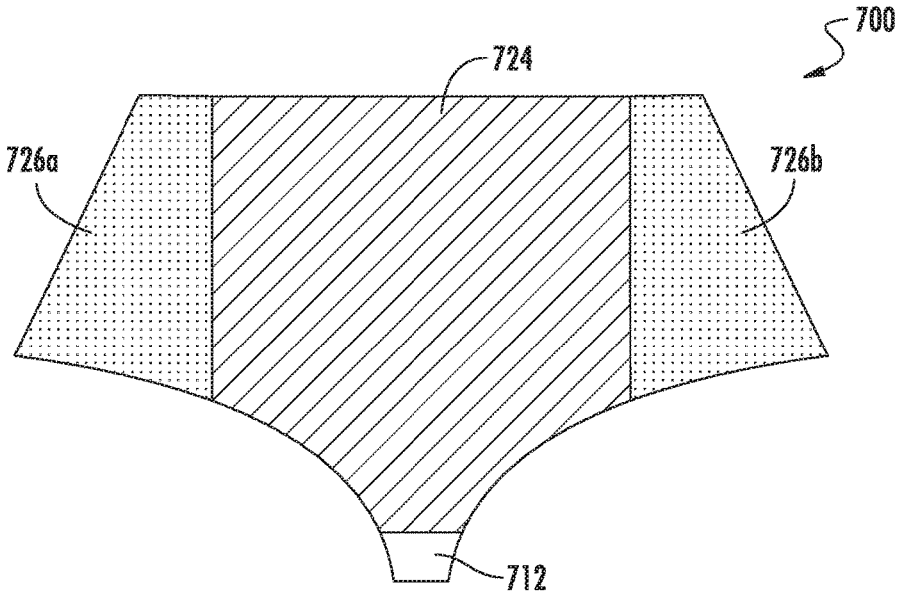
FIGS. 7A and 7B illustrate front inner and outer fabrics of a bottom of a two-piece swimsuit according to one implementation.
Figure 7B:
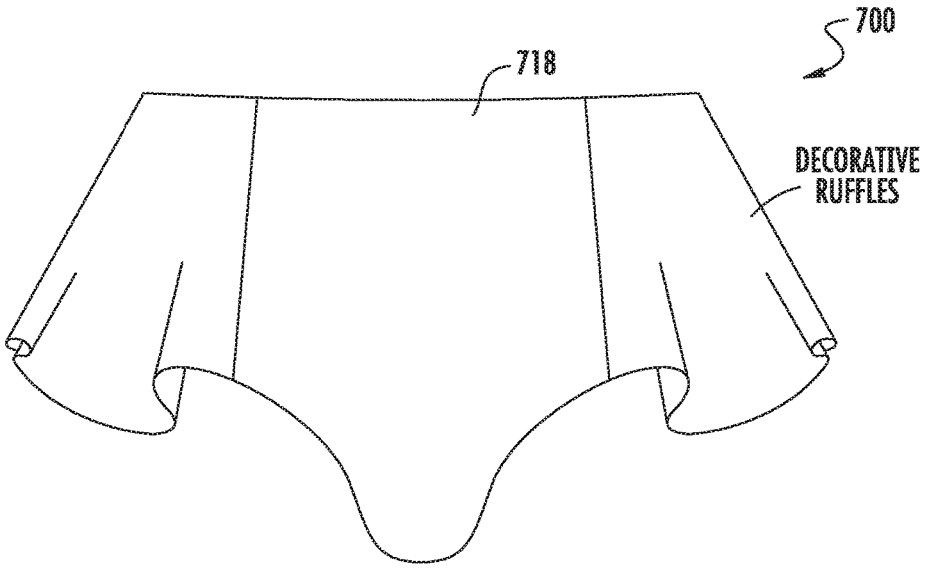

FIGS. 7A and 7B illustrate a swimsuit bottom 700 according to one implementation. FIG. 7A illustrates a front inner fabric 712 of the swimsuit 700, and FIG. 7B illustrates a front outer fabric 718 of the swimsuit 700. The back inner and outer fabrics are not shown and may or may not include an adhesive layer between them. The front inner fabric 712 includes a central fabric portion to which a first adhesive layer 724 is tacked and side fabric portions to which second adhesive layers 726*a*, 726*b* are tacked. The first adhesive layer 724 extends vertically between the top edge of the swimsuit bottom 700 to just above the lower horizontal edge of the bottom 700 and horizontally between (or slightly inwardly of) the front points on the wearer's right and left hip bones. Each second adhesive layer 726*a*, 726*b* extends from the respective adjacent lateral edge of the first adhesive layer 724 toward the respective side of the wearer's abdomen. The compressive strength of the first adhesive layer 724 is greater than the compressive strength of the second adhesive layers 726*a*, 726*b*.

Figure 8A:
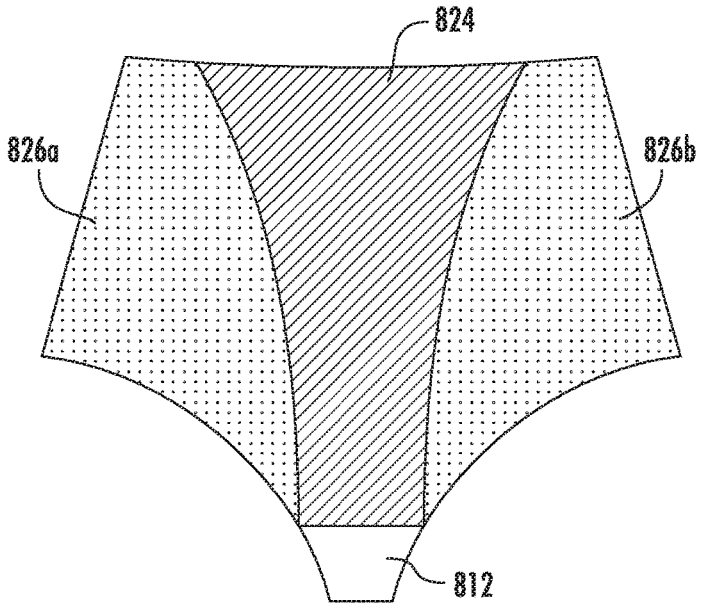
FIGS. 8A and 8B illustrate front inner and outer fabrics of a bottom of a two-piece swimsuit according to another implementation.
Figure 8B:
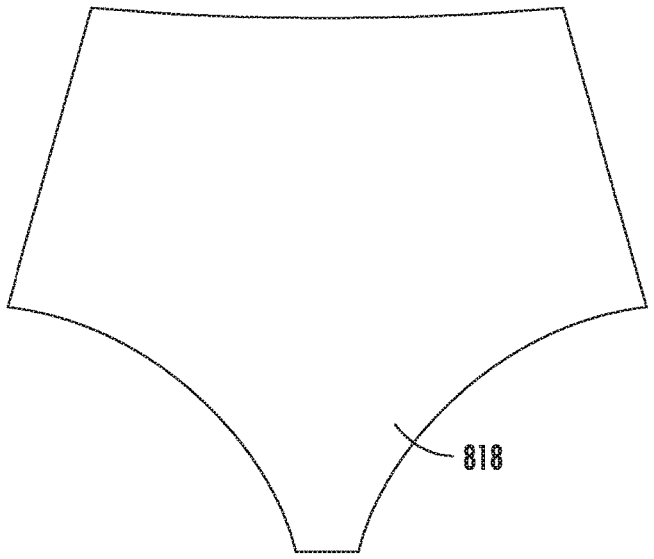

FIGS. 8A and 8B illustrate a swimsuit bottom 800 according to another implementation. FIG. 8A illustrates a front inner fabric 812 of the swimsuit 800, and FIG. 8B illustrates a front outer fabric 818 of the swimsuit 800. The back inner and outer fabrics are not shown and may or may not include an adhesive layer between them. The front inner fabric 812 includes a central fabric portion to which a first adhesive layer 824 is tacked and side fabric portions to which second adhesive layers 826*a*, 826*b* are tacked. The first adhesive layer 824 is narrower than the first adhesive layer 724 shown in FIG. 7A. Each second adhesive layer 826*a*, 826*b* extends from the respective adjacent lateral edge of the first adhesive layer 824 toward the respective side of the wearer's abdomen. The compressive strength of the first adhesive layer 824 is greater than the compressive strength of the second adhesive layers 826*a*, 826*b*.

Figure 9A:
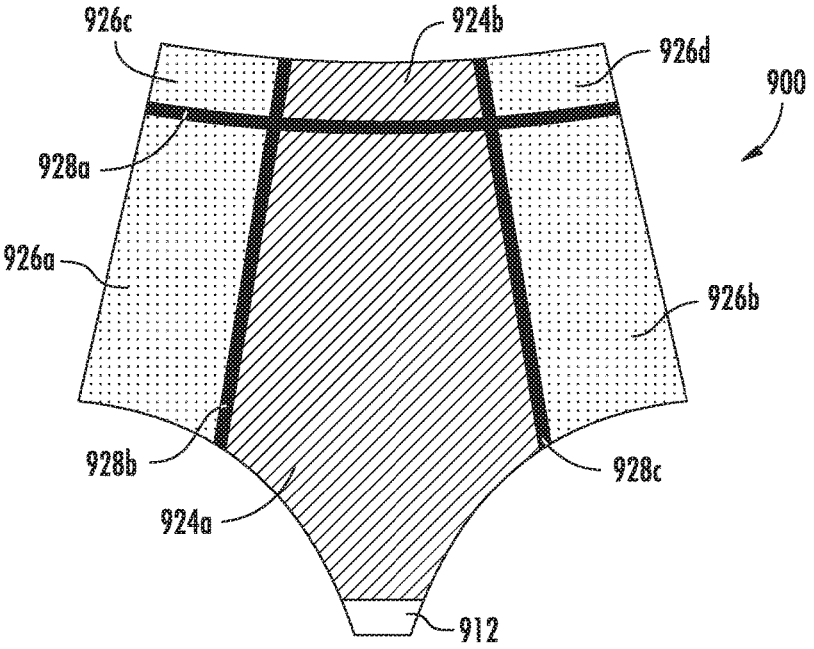
FIGS. 9A and 9B illustrate front inner and outer fabrics of a bottom of a two-piece swimsuit according to another implementation.
Figure 9B:
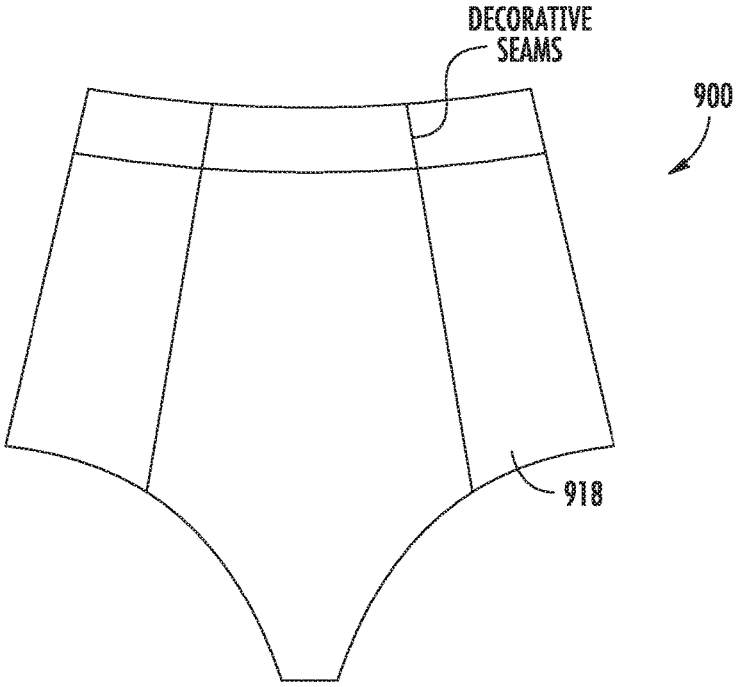

FIGS. 9A and 9B illustrate a swimsuit bottom 900 according to another implementation. FIG. 9A illustrates a front inner fabric 912 of the swimsuit 900, and FIG. 9B illustrates a front outer fabric 918 of the swimsuit 900. The back inner and outer fabrics are not shown and may or may not include an adhesive layer between them. The front inner fabric 912 includes central fabric portions to which first adhesive layers 924*a*, 924*b* are tacked, side fabric portions to which second adhesive layers 926*a*, 926*b*, 926*c*, 926*d* are tacked, and intermediate fabric portions to which third adhesive layers 928*a*, 928*b*, 928*c* are tacked. The first adhesive layer 924*a* is centrally disposed on the front inner fabric 912, and first adhesive layer 924*b* is spaced apart from and disposed above the first adhesive layer 924*a*. Extending horizontally between and adjacent to the first adhesive layers 924*a*, 924*b* is third adhesive layer 928*a*. Second adhesive layers 926*a*, 926*b* are spaced apart from and are disposed to the left and right, respectively, of the first adhesive layer 924*a*. Similarly, second adhesive layers 926*c*, 926*d* are spaced apart from and disposed to the left and right, respectively, of the first adhesive layer 924*b* and are spaced apart from and above respective second adhesive layers 926*b*, 926*c*. Third adhesive layer 928*b* extends between second adhesive layer 926*c* and first adhesive layer 924*b* and between second adhesive layer 926*a* and first adhesive layer 924*a*. Third adhesive layer 928*c* extends between second adhesive layer 926*d* and first adhesive layer 924*b* and between second adhesive layer 926*b* and first adhesive layer 924*a*. The third adhesive layer 928*a* extends substantially across a portion of the horizontal width of the bottom 800, and the third adhesive layers 928*b*, 928*c* extend substantially from the top edge of the bottom 800 to the leg opening of the bottom 800. In addition, as shown in FIG. 8A, the third adhesive layers 928*b*, 928*c* may be askew relative to each other, such that upper ends of the portions 928*b*, 928*b* are closer together than lower ends of the portions 928*a*, 928*b*. The third adhesive layers 928*a*, 928*b*, 928*c* have a compressive strength between the compressive strength of the first adhesive layers 924*a*, 924*b* and the compressive strength of the second adhesive layers 926*a-d*.

Figure 10A:
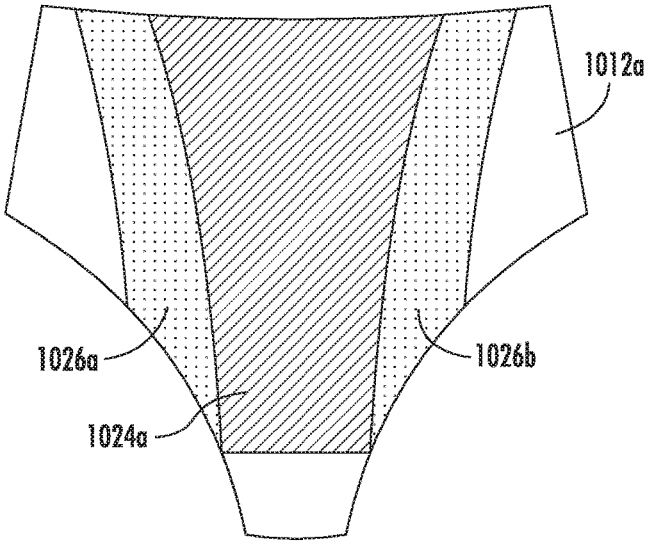
FIGS. 10A and 10B illustrate front and back inner fabrics of a bottom of a two-piece swimsuit according to another implementation.
Figure 10B:
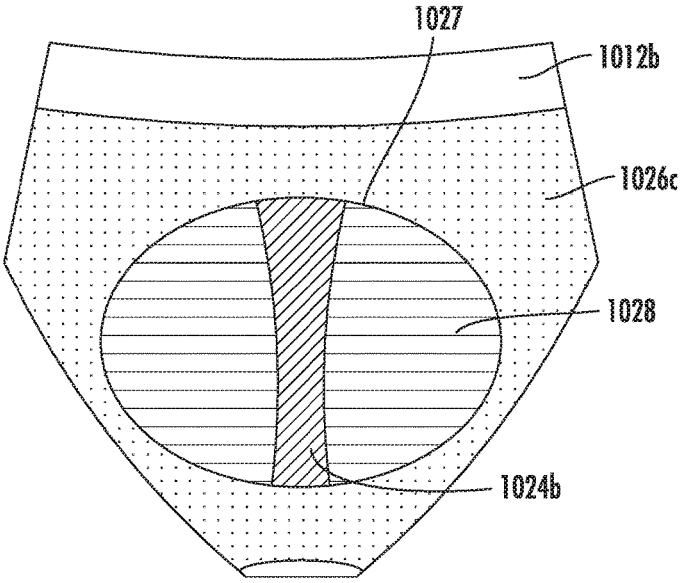

FIGS. 10A and 10B illustrate a swimsuit bottom 1000 according to another implementation. FIG. 10A illustrates a front inner fabric 1012*a* of the swimsuit 1000, and FIG. 10B illustrates a back inner fabric 1012*b* of the swimsuit 1000. The front and back outer fabrics are not shown but are tacked to the respective portions of the inner front fabric 1012*a* and inner back fabric 1012*b*. The front inner fabric 1012*a* includes a central fabric portion to which a first adhesive layer 1024*a* is tacked and side fabric portions to which second adhesive layers 1026*a*, 1026*b* are tacked. The first adhesive layer 1024*a* extends vertically between the top edge of the swimsuit bottom 1000 to just above the lower horizontal edge of the bottom 1000 and horizontally between (or slightly inwardly of) the wearer's right and left hip bones. The width of the first adhesive layer 1024*a* tapers inwardly from the top edge of the swimsuit 1000 toward the lower edge of the swimsuit 1000. Second adhesive layer 1026*a*, 1026*b* extend from the respective adjacent vertical edge of the first adhesive layer 1024*a* toward the respective side of the wearer's abdomen about 1 to about 4 inches. As shown, the second adhesive layers 1026*a*, 1026*b* have a substantially uniform width and are cut to follow the vertical edge contour of the first adhesive layers 1024*a*.

As shown in FIG. 10B, the back inner fabric 1012*b* defines an oval shaped hole 1027 adjacent a central portion thereof. A polyspandex liner 1028 is bonded or sewn to the perimeter of the hole 1027. First adhesive layer 1024*b*, which is substantially rectangularly shaped, is tacked to a central portion of the liner 1028 such that the longer sides of the portion 1024*b* extend vertically and the shorter sides of portion 1024*b* extend horizontally. Second adhesive layer 1026*c* is tacked to most or all of the remaining portion of the back inner fabric 1012*b*. The compressive strength of the first adhesive layers 1024*a*, 1024*b* is greater than the compressive strength of the second adhesive layers 1026*a*, 1026*b*, 1026*c* and the polyspandex liner 1028.

Figure 11A:
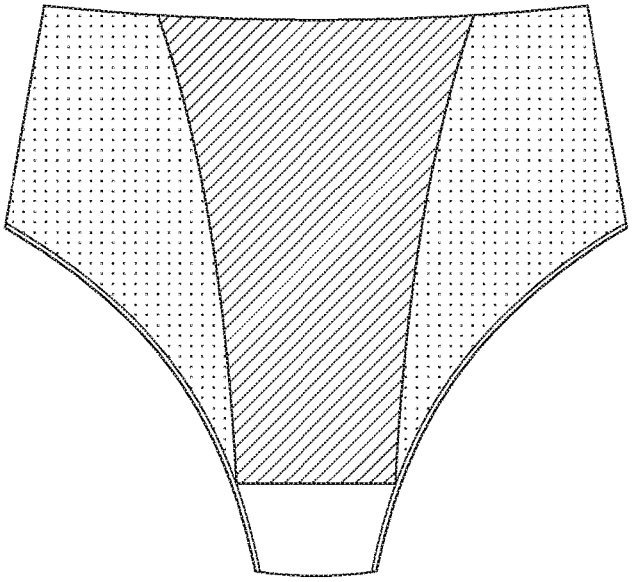
FIGS. 11A and 11B illustrate front and back inner fabrics of a bottom of a two-piece swimsuit according to another implementation.
Figure 11B:
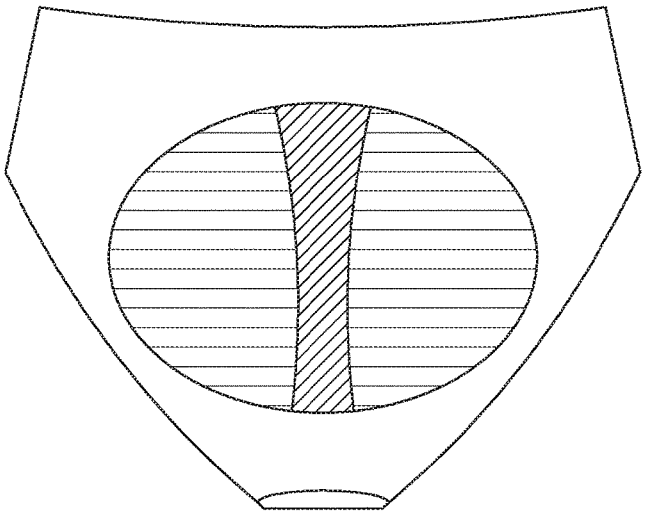

FIGS. 11A and 11B illustrate a swimsuit bottom 1100 according to another implementation. FIG. 11A illustrates a front inner fabric 1112*a* of the swimsuit 1100, and FIG. 11B illustrates a back inner fabric 1112*b* of the swimsuit 1100. The front and back outer fabrics are not shown but are tacked to the respective portions of the inner front fabric 1112*a* and inner back fabric 1112*b*. The front inner fabric 1112*a* includes a central fabric portion to which a first adhesive layer 1124*a* is tacked and side fabric portions to which second adhesive layers 1126*a*, 1126*b* are tacked. The first adhesive layer 1124*a* extends vertically between the top edge of the swimsuit bottom 1100 to above the lower horizontal edge of the bottom 1100 and horizontally between (or slightly inwardly of) the wearer's right and left hip bones. The width of the first adhesive layer 1124*a* tapers inwardly from the top edge of the swimsuit 1100 toward the lower edge of the swimsuit 1100. Second adhesive layer 1126*a*, 1126*b* extend from the respective adjacent lateral edge of the first adhesive layer 1124*a* toward the respective side of the wearer's abdomen.

As shown in FIG. 11B, the back inner fabric 1112*b* defines an oval shaped hole 1127 adjacent a central portion thereof. A polyspandex liner 1128 is bonded or sewn to the perimeter of the hole 1127. First adhesive layer 1124*b*, which is substantially rectangularly shaped, is tacked to a central portion of the liner 1128 such that the longer sides of the portion 1124*b* extend vertically and the shorter sides of portion 1124*b* extend horizontally. Unlike the swimsuit 1000 shown in FIG. 10B, the swimsuit 1100 does not include second adhesive layers tacked to the back inner fabric 1112*b*. The compressive strength of the first adhesive layers 1124*a*, 1124*b* is greater than the compressive strength of the second adhesive layers 1126*a*, 1126*b* and the polyspandex liner 1128.

The implementations described above in relation to FIGS. 1A through 11B are intended to be exemplary and should not be construed to limit the scope of the invention. For example, in the implementations described above, the adhesive layers are first tacked to portions of the outer side of the inner fabric. However, in other implementations, the adhesive layers may be tacked to portions of an inner side of the outer fabric first. Other variations in the patterns, compressive strength, and/or placement of the adhesive layers relative to portions of the fabric may vary depending on the aesthetic characteristics to be achieved by the garment. Also, the above implementations are directed to articles of swimwear, but it should be understood that the scope of the invention would extend similarly to other types of garments having targeted compression areas, such as, for example, undergarments, athletic garments, and outerwear.

Figure 12:
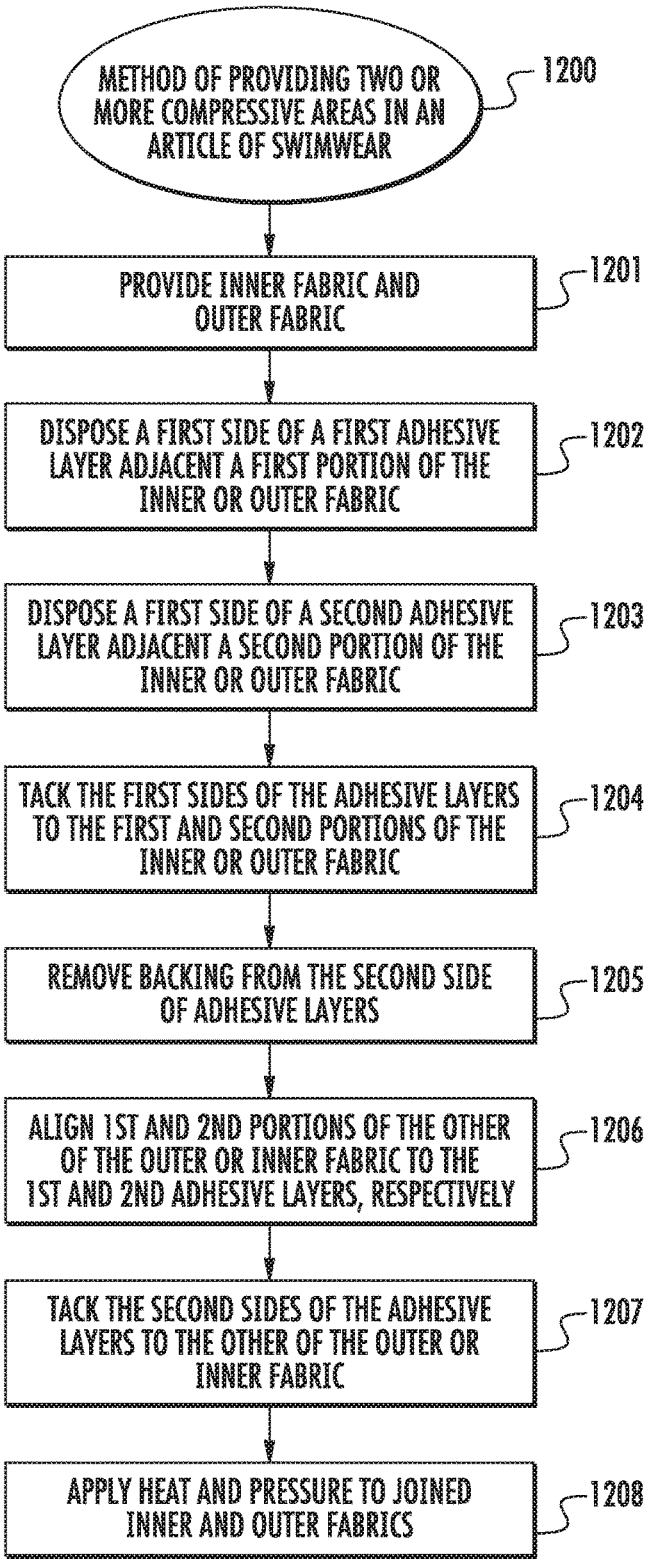
FIG. 12 illustrates a method of manufacturing swimwear according to various implementations.

FIG. 12 illustrates a method 1200 of providing two or more compressive areas in garment according to one implementation. Beginning at step 1201, an inner fabric and an outer fabric are provided. For example, the inner front and outer front fabrics are cut into the shape of the front of an article of swimwear. The inner back and outer back fabrics may also be cut into the shape of the back of the article of swimwear. Next, in step 1202, a first side of a first adhesive layer having a first compressive strength is disposed adjacent a first portion of the inner or outer fabric, and in step 1203, a first side of a second adhesive layer having a second compressive strength is disposed adjacent a second portion of the inner or outer fabric. The first compressive strength is greater than the second compressive strength. In addition, the first and second portions of the inner or outer fabric may be adjacent to each other or spaced apart from each other. In step 1204, the first sides of the first and second adhesive layers are tacked, or bonded, to the first and second portions, respectively, of the inner or outer fabric. Tacking includes applying heat and pressure to the first and second portions. Next in step 1205, a backing is removed from a second side of each of the first and second adhesive layers. Then, in step 1206, the first and second portions of the other of the outer or inner fabric are aligned with the first and second adhesive layers, respectively. In step 1207, the first and second portions of the outer or inner fabric are tacked to the second side of the first and second adhesive layers, respectively, using heat and pressure. Finally, in step 1208, heat and pressure are applied to the joined inner and outer fabrics with the adhesive layers there between.

In implementations that use a polyamide pin dot adhesive, the heat applied in step 1208 may range from between about 130° C. to about 160° C. and the pressure applied in step 1208 may be about 5 to about 30 N/cm$^2$ for about 12 to about 20 seconds. In implementations that use a polyurethane pin dot adhesive, the heat applied in step 1208 may range from between about 145° C. to about 165° C. and the pressure applied is about 5 to about 20 N/cm$^2$ for about 12 to about 20 seconds. Step 1208 may include a second and/or final pressing of the bonded garment. Typically, the initial temperature, pressure, and duration for tacking in step 1207 may be less than these ranges. However, in certain implementations, the initial temperature, pressure, and duration may be within the listed ranges.

The garments recited in the appended claims are not limited in scope by the specific garments and methods of providing the same described herein, which are intended as illustrations of a few aspects of the claims and any garments or methods that are functionally equivalent are intended to fall within the scope of the claims. Various modifications of the garments and methods in addition to those shown and described herein are intended to fall within the scope of the appended claims. Further, while only certain representative garments and method steps disclosed herein are specifically described, other combinations of the garments and method steps are intended to fall within the scope of the appended claims, even if not specifically recited. Thus, a combination of steps, elements, components, or constituents may be explicitly mentioned herein. However, other combinations of steps, elements, components, and constituents are included, even though not explicitly stated. The term "comprising" and variations thereof as used herein is used synonymously with the term "including" and variations thereof and are open, non-limiting terms.

Furthermore, certain terminology is used in the above description for convenience only and should not be construed as overly limiting. For example, the words "right," "left," "lower," "bottom," "top," and "upper" designate direction in the drawings to which reference is made. The words "inner" and "outer" refer to directions toward and away from, respectively, the geometric center of the described feature or garment.

In addition, various components may be described herein as extending horizontally and vertically or as being disposed laterally relative to other components. Unless otherwise specified herein, the terms "horizontal" and "vertical" are used to describe the orthogonal directional components of various features, and the term "lateral" is used to describe the relative orientation of components in the horizontal direction. Accordingly, the directional terms "horizontal" and "vertical" are used to describe the components merely for the purposes of clarity and illustration and are not meant to be limiting.

The invention claimed is:

1. A method of providing one or more compressive areas in a garment comprising:

disposing a first side of a first adhesive layer adjacent a first fabric portion of one of an inner or an outer fabric, the inner fabric configured for being disposed against a wearer's skin;

disposing a first side of a second adhesive layer adjacent a second fabric portion of the inner or outer fabric;

tacking first sides of the first adhesive layer and the second adhesive layer to the first and second fabric portions, respectively, of the inner or outer fabric, wherein tacking comprises applying heat and pressure to the first and second fabric portions of the inner or outer fabric;

removing a backing from the second sides of the first and second adhesive layers;

aligning a first fabric portion of the other of the outer or inner fabric to a second side of the first adhesive layer, the second side of the first adhesive layer being opposite the first side of the first adhesive layer;

aligning a second fabric portion of the other of the outer or inner fabric to a second side of the second adhesive layer, the second side of the second adhesive layer being opposite the first side of the second adhesive layer; and tacking the second sides of the first adhesive layer and the second adhesive layer to the first and second fabric portions, respectively, of the other of the outer or inner fabric;

wherein the first adhesive layer has a first compressive strength when bonded to the first fabric portions of the inner and outer fabrics, and the second adhesive layer has a second compressive strength when bonded to the second fabric portions of the inner and outer fabrics, the first compressive strength being greater than the second compressive strength.

2. The method of claim 1, wherein disposing a first side of a first adhesive layer and a first side of a second adhesive layer comprises directly applying the first and second adhesive layers to the first and second portions of fabric, respectively.

3. The method of claim 1, further comprising applying heat and pressure to the inner and outer fabrics after tacking the second sides of the adhesive layers to the first and second fabric portions of the other of the outer or inner fabric.

4. The method of claim 1, wherein the first adhesive layer comprises a first polyurethane sheet on which a first plurality of adhesive dots are disposed and spaced apart from each other, and the second adhesive layer comprises a second polyurethane sheet on which a second plurality of adhesive dots are disposed and spaced apart from each other, wherein a volume of the dots on the first sheet is greater than a volume of the dots on the second sheet.

5. The method of claim 1, wherein the garment is an article of swimwear.

* * * * *